US007392789B2

(12) United States Patent
Dietl et al.

(10) Patent No.: US 7,392,789 B2
(45) Date of Patent: Jul. 1, 2008

(54) METHOD FOR SYNCHRONIZING CYLINDERS IN TERMS OF QUANTITIES OF FUEL INJECTED IN AN INTERNAL COMBUSTION ENGINE

(75) Inventors: Roland Dietl, Regensburg (DE); Hans-Peter Rabl, Kelheim (DE); Janos Radeczky, Wenzenbach (DE)

(73) Assignee: Siemens Aktiengesellschaft, Munich (DE)

( * ) Notice: Subject to any disclaimer, the term of this patent is extended or adjusted under 35 U.S.C. 154(b) by 42 days.

(21) Appl. No.: 10/597,846

(22) PCT Filed: Feb. 1, 2005

(86) PCT No.: PCT/EP2005/050428

§ 371 (c)(1),
(2), (4) Date: Aug. 9, 2006

(87) PCT Pub. No.: WO2005/078263

PCT Pub. Date: Aug. 25, 2005

(65) Prior Publication Data

US 2007/0163543 A1 Jul. 19, 2007

(30) Foreign Application Priority Data

Feb. 10, 2004 (DE) ..... 10 2004 006 554

(51) Int. Cl.
*F02D 41/36* (2006.01)

(52) U.S. Cl. ..... 123/436; 123/687; 123/673

(58) Field of Classification Search ..... 123/436, 123/673, 687, 352, 492, 493; 701/110
See application file for complete search history.

(56) References Cited

U.S. PATENT DOCUMENTS

| | | | | |
|---|---|---|---|---|
| 4,667,634 | A | 5/1987 | Matsumura et al. | 123/357 |
| 4,688,535 | A * | 8/1987 | Kuttner et al. | 123/436 |
| 5,385,129 | A * | 1/1995 | Eyberg | 123/436 |
| 5,809,969 | A * | 9/1998 | Fiaschetti et al. | 123/436 |
| 6,085,143 | A * | 7/2000 | Przymusinski et al. | 701/110 |
| 6,513,496 | B2 * | 2/2003 | Yomogida | 123/436 |

FOREIGN PATENT DOCUMENTS

| | | |
|---|---|---|
| DE | 19700711 A1 | 9/1998 |
| DE | 19855939 A1 | 6/1999 |
| DE | 19720009 C2 | 8/2000 |
| DE | 10012025 A1 | 10/2001 |
| JP | 11280530 | 10/1999 |

OTHER PUBLICATIONS

International Search Report and Written Opinion for International Application No. PCT/EP2005/050428 (13 pages), Apr. 18, 2005.

* cited by examiner

*Primary Examiner*—Hai H Huynh
(74) *Attorney, Agent, or Firm*—Baker Botts L.L.P.

(57) ABSTRACT

In an adaptation (4, 5, 6, 7) of differences in injected quantities within high operating ranges, the differences are based on an injection parameter and are determined by regulating an irregular operation in an operating point within the lower operating ranges. The injection parameter which determines the differences in injected quantities in the lower operating point is set on a value different from the normal operating value in this point. The dynamics of the operating point varying with the corresponding parametric value of injection is limited during adaptation (4, 5, 6, 7).

18 Claims, 2 Drawing Sheets

METHOD FOR SYNCHRONIZING CYLINDERS IN TERMS OF QUANTITIES OF FUEL INJECTED IN AN INTERNAL COMBUSTION ENGINE

CROSS-REFERENCE TO RELATED APPLICATIONS

This application is a U.S. national stage application of International Application No. PCT/EP2005/050428 filed Feb. 1, 2005, which designates the United States of America, and claims priority to German application number DE 10 2004 006 554.3 filed Feb. 10, 2004, the contents of which are hereby incorporated by reference in their entirety.

TECHNICAL FIELD

The invention relates to a method for synchronizing, between the cylinders of an internal combustion engine, the differences in the quantity of fuel injected. According to this method, the differences in the quantity of fuel injected which exist at an operating point in the lower engine-speed range with the injection parameter values valid at that point under normal operating conditions are determined by means of a method of measuring individual cylinders to record the irregularity in the running of the internal combustion engine and, having been assigned to the low operating point, are learned. Also, according to this method, for operating ranges with higher loads and engine speeds, an adaptation of the differences in the quantity of fuel injected is carried out for a chosen injection parameter.

BACKGROUND

A method of this type is already known from DE 197 00 711 A1.

In a multi-cylinder internal combustion engine, a systematic error in the injection of fuel into the combustion chambers arises as a result of variances, in particular in the mechanical properties of the injection device, for example of the injectors in diesel engines with a common-rail injection system. Due to manufacturing tolerances of the said components and differing degrees of wear (ageing effects), differing quantities of fuel are fed for combustion in the individual cylinders in identical injection periods and under otherwise identical boundary conditions. The differing quantities of fuel lead to a differing output of power by the individual cylinders which, as well as increasing the irregularity in the running of the engine, also leads to an increase in the quantity of harmful exhaust-gas components.

It is known for the irregularity in the running of an internal combustion engine to be analyzed in order to draw conclusions therefrom as to the quantity of fuel injected in the various combustion chambers. For this purpose, for example the angular acceleration of the crankshaft is measured with an engine-speed sensor, said angular acceleration depending on the quantity of fuel injected in each case. Thus a large quantity of fuel injected in the combustion cycle concerned causes a correspondingly large angular acceleration of the crankshaft, whereas a small quantity of fuel injected results in only a correspondingly reduced angular acceleration. This irregularity in the running of the engine is countered in known internal combustion engines by adjusting the quantities of fuel injected in the individual combustion chambers in relation to one another through appropriate activation of the various injectors. In this process, the control signals for the various injectors are altered until such time as all the cylinders make the same contribution to the torque, which indicates that a uniform quantity of fuel is being injected in the various combustion chambers.

This known regulation of irregularities in the running of the engine for synchronizing cylinders in terms of the quantities of fuel injected is restricted in application to low load levels under stationary operating conditions, for example idling. Braking or accelerating, as typically occur in higher operating ranges, could be interpreted incorrectly by the speed sensor on the crankshaft as a difference in the quantity of fuel injected.

The restriction to a low operating point for determining differences in quantities of fuel injected is, however, problematical, since these vary with at least one of the injection parameters, e.g. injection pressure and injection period. The differences in quantities of fuel injected that are determined at a low operating point cannot therefore be used for synchronizing over the whole operating range, e.g. as global correction factors for an activation parameter of the injectors, but have to be adapted to the injection parameters applicable at higher operating points. However, due to the aforementioned requirement for stationary operating conditions for regulating irregularities in the running of the engine, this is not possible without further action.

In the above-mentioned DE 197 00 711 A1, in which correction factors for individual cylinders are applied to the injection period in order to synchronize the cylinders in terms of the quantity of fuel injected, it is proposed that the correction factors determined at a low operating point be adapted by an adaptation factor f(p,t), which is dependent on the injection parameters of pressure and injection period, for higher operating ranges. The values of this adaptation factor are to be stored in an engine characteristics map and taken therefrom for adaptation of the correction factors during operation. While the known method prevents adaptation when the operating conditions are not stationary, it does so only with the aid of a predetermined engine characteristics map whose values cannot optimally match the dependency conditions of the differences in the quantity of fuel injected which exist in reality and which change over the service life of the vehicle.

SUMMARY

The object of the invention is to indicate a method of the type stated in the introduction which allows the actual injection-parameter-dependent systematic error in terms of quantities of fuel injected to be determined in a simple manner with a view to cylinder synchronization.

According to the invention, in a generic method the chosen injection parameter is set at the low operating point for adaptation to a value which deviates from the value applicable at that point under normal operating conditions. Normal operating conditions are understood to mean that e.g. at low loads corresponding low injection pressures apply. By contrast, normal operating conditions are deviated from if e.g. at low loads high injection pressures apply. The differences in the quantity of fuel injected can then be determined for this set injection parameter value by measuring the irregularity in the running of the engine and can be learned as adaptation values assigned to the respective injection parameter value. During this adaptation, care must be taken to ensure that the movement of the operating point which can change with the injection parameter value set in each case is limited, since a changed injection parameter value would otherwise express itself in a braking or acceleration that was not initiated by the driver of the vehicle, at any rate in a new operating point, i.e. in non-stationary conditions during the adaptation process.

A particularly preferred embodiment of the method is one in which, to limit the movement of the low operating point during adaptation, at least one second injection parameter is set such that the operating point remains at least approximately stationary. This can advantageously be achieved in that, when the injection pressure, chosen as an injection parameter, is adapted to successively higher values in order to limit the movement of the low operating point, a correspondingly shorter injection period is set in each case. The second or further injection parameters are controlled here as auxiliary variables such that the driver does not notice the adaptation process at all. Since just a few piston strokes are sufficient for adaptation, the engine control can also without further action be set such that the driver cannot cancel the stationary conditions during the critical adaptation phase, or only where a threshold is exceeded in the desired output requested by the driver via the throttle.

All embodiments of the inventive method provide the advantage that a low operating point can be selected for adaptation, at which the maximum sensitivity and/or reliability of measurement of the irregularity in the running of the engine is achieved, although a correct adaptation is made for high operating ranges. In particular, the low operating point can be chosen in the idling range.

The adaptation values learned serve to calculate correction factors for individual cylinders, by means of which correction factors, generally as part of the regulation of the irregularity in the running of the engine during the adaptation process and under operating conditions, an activation parameter of an injection device of the internal combustion engine is applied such that a synchronization of the quantities of fuel injected occurs.

It has proven to be advantageous in this respect for the injection device for each cylinder to be formed by an injector with a piezoelectric actuator, the activation energy of the actuators being used as an activation parameter. The actuator deviation necessary for synchronization can thus be adapted, in particular for different injection pressure values.

In order to record the irregularity in the running of the internal combustion engine, the angular acceleration of the crankshaft of the internal combustion engine caused by the differing quantities of fuel injected in individual cylinders can be analyzed. The determination of adapted differences in the quantity of fuel injected or of adapted correction factors for synchronization can consequently be based upon very accurate measurement methods.

The inventive method also opens up the possibility that at the stationary operating point set for adaptation with synchronized quantities of fuel injected, the absolute value of the associated quantity of fuel injected is determined from a stored model of the torque of the internal combustion engine. Diagnosis of the absolute value of the quantity of fuel injected is vital for compliance with limits on exhaust emissions, particularly where the diagnosis of small injection quantities, especially of pre-injection quantities, which lie in the region of a few milligrams, is concerned.

BRIEF DESCRIPTION OF THE DRAWINGS

The invention is described in detail below with the aid of the schematic drawings, in which.

DETAILED DESCRIPTION

After the start 1 of the synchronization of injection quantities, an initialization phase 2 is provided as the next step, in which the adaptation values stored in an earlier diagnostic cycle are loaded into an engine control device (not shown). The initialization of a new diagnostic cycle can take place both after each starting of the internal combustion engine and after certain predeterminable time or maintenance intervals.

After the end of initialization 2, the checking of the activation conditions occurs in a passive diagnosis step 3. Here, it is a matter of waiting until preferred operating conditions have been reached for adaptation to a normal injection parameter value or one that deviates therefrom. These include, for example, the load, the engine speed or the coolant temperature. The engine control will optionally have to be adjusted so that in the subsequent adaptation process the dynamics of the change over time of the operating point sought for implementing the adaptation cycle are limited.

Figure 1:
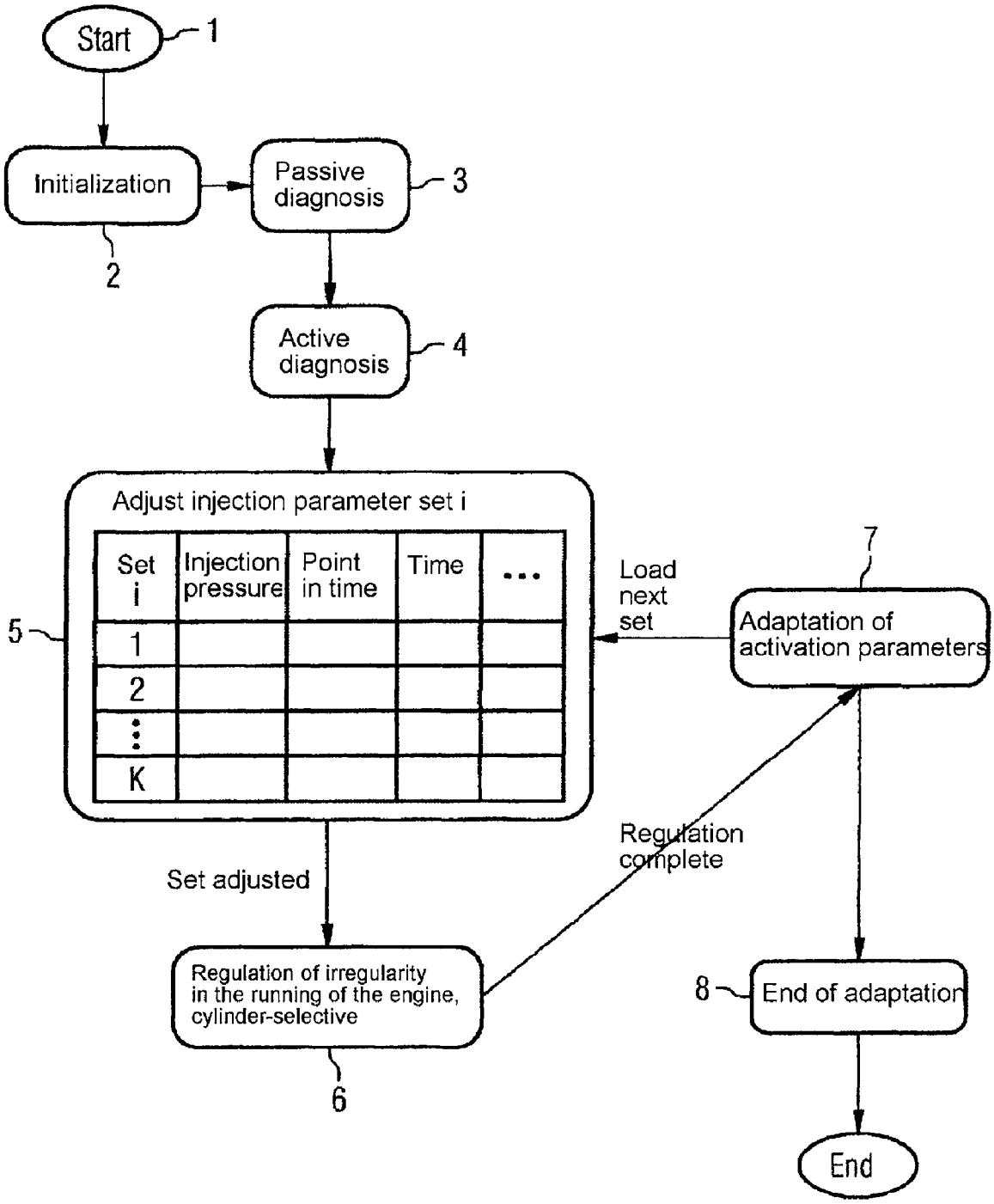
FIG. 1 shows a flow diagram of the implementation of the method of synchronizing quantities of fuel injected according to the invention.

As soon as the activation conditions are fulfilled, the actual active diagnosis cycle 4 is started. Firstly, a regulation of the irregularity 6 in the running of the engine is carried out with the normal injection parameters 5 associated with the engine operating state (cf. set of injection parameters in FIG. 1). As a result, the quantities of fuel injected by the individual injectors of the internal combustion engine at the preferred low operating point are synchronized with one another. There is, on the other hand, also the additional opportunity for analyzing at this point in the process that at the preferred low operating point with the predetermined normal injection parameter values an injection quantity that is known from the torque model will be decided upon which, according to the torque achieved, must apply.

Thereafter, in step 7 (adaptation of activation parameters), further injection parameters or injection parameter sets i are loaded and, for this purpose, regulation of the irregularity in the running of the engine is carried out in each case, comprising a determination of the differences in the injection quantity prevailing at the set value of the chosen injection parameter or comprising synchronization by means of appropriate correction factors for an activation parameter. For adaptation, a suitable activation parameter such as, for example, the energy fed to the actuators, is selected. The resulting adaptation values are assigned to the injection parameter set, i.e. primarily to the injection parameters such as e.g. injection pressure and injection period, whose influence on the differences in the quantity of fuel injected is to be maintained, assigned and stored in order that they can be called up later, when operating with higher loads and engine speeds and the associated normal values of the chosen injection parameter, for directly synchronizing quantities of fuel injected without a diagnostic cycle. If the adaptation was carried out for a sufficiently large number of checkpoints (typically from five to ten), i.e. for example for all i=1 to i=k injection parameter values of the pressure, the end 8 of the adaptation or of the current diagnostic cycle is reached and the stored adaptation values can be used under operating conditions for synchronizing the quantities of fuel injected.

It has emerged that the differing injection quantities of injectors, which injection quantities are dependent on the injection period, can be synchronized with one another in a simple manner by changing the displacement of the actuators. This means, for example, that for various injection pressures chosen as injection parameter values, an adaptation of the actuator displacement is carried out. On the other hand, the activation energy used as an injector control variable can of course also be used for varying the start of injection.

In each diagnostic cycle, the adaptation values or correction factors last stored are overwritten by the newly determined ones, as a result of which account is taken in particular of the ageing effects of the injection device that have occurred in the meantime and which will possibly lead to changed variances with regard to the quantities of fuel injected into the various combustion chambers.

Figure 2:
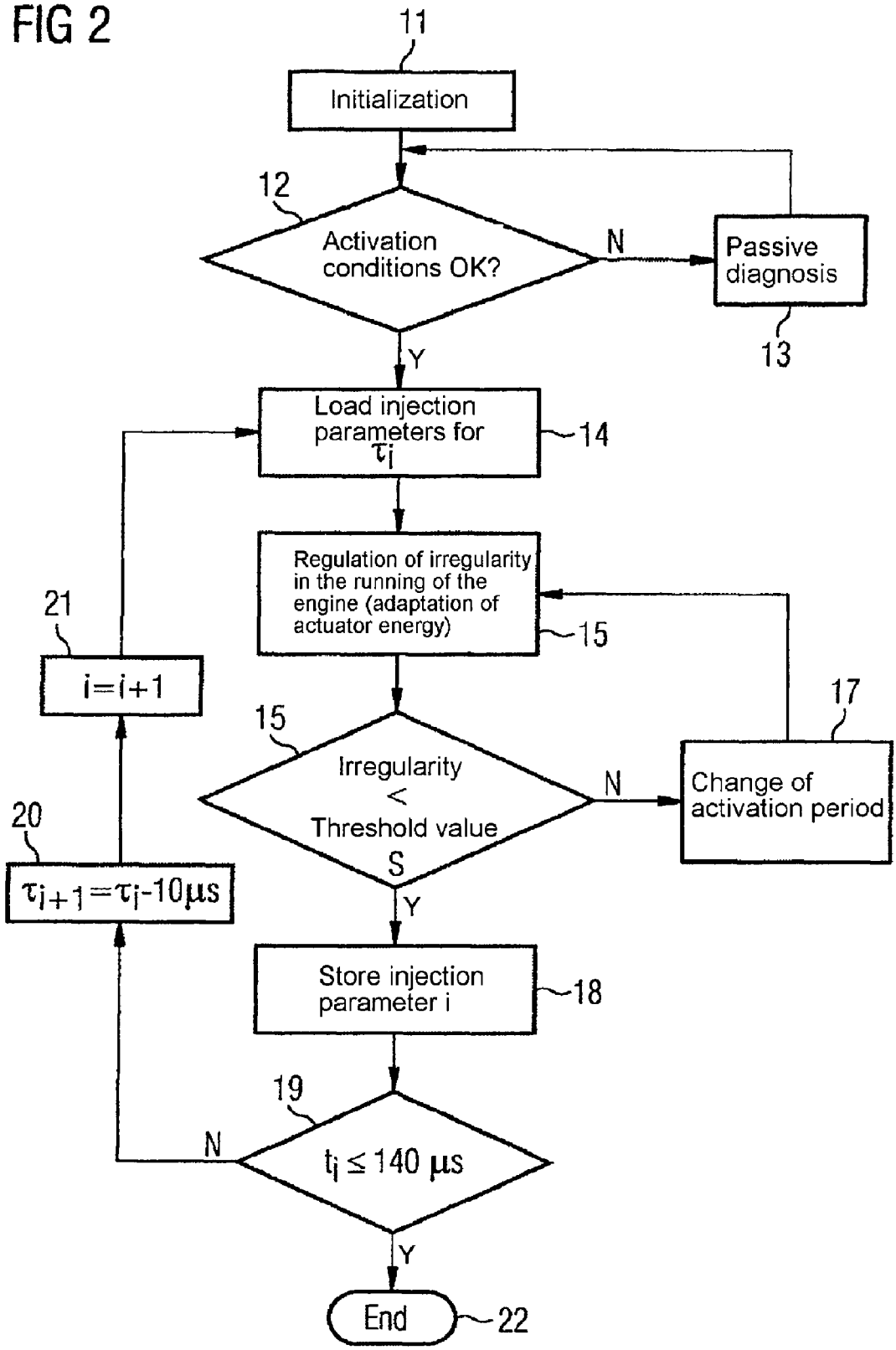
FIG. 2 shows a flow diagram of the implementation of the preferred method of synchronizing quantities of fuel injected by adapting the loading time.

The method shown in FIG. 2 implements in step 11 an initialization. In this step, the stored adaptation values are loaded. In step 12, a check is carried out as to whether the activation conditions are fulfilled, i.e. whether constant operating conditions such as e.g. constant load, constant engine speed, constant temperature of the coolant, etc. apply. In this way, the diagnosis remains passive, as shown in step 13, until in step 12 the activation conditions are fulfilled. Then in step 14, the process continues whereby the injection parameters for an initial loading/unloading time are loaded. The initial loading/unloading time can in this way be set to 200 μs, for example. The injection parameters include injection pressure, injector energy, type of injection, i.e. whether it is a pre-injection, main injection or post-injection. Once these parameters are loaded, then in step 15 the process continues to regulation of the irregularity in the running of the engine. The regulation of the irregularity in the running of the engine is carried out cylinder-selectively, i.e. for a four-cylinder engine, for example, cylinder no. 1 is regulated first. Once the injection parameters are set for the injector of cylinder no. 1, then the injector of the second cylinder follows. The regulation can set the loading/unloading time, the injection pressure, the activation energy and the type of injection. In special cases, the regulation can be carried out for a defined (fixed) activation period (injection period) and defined (fixed) injection pressure, the actuator energy being adapted accordingly. At a rail pressure of, for example, 1500 bar and an injection quantity of 0.84 mg, activation times of less than 160 μs have to be implemented.

In step 16, a check is carried out to ascertain whether with these variables the irregularity in the running of the engine lies below a threshold value S. If this is not the case, then in step 17 the activation period must also be changed. This is necessary in particular in the case of "badly" manufactured injectors which cope badly with these short loading/unloading times, if at all. With such injectors and short unloading times, the fuel quantity injected is independent of the actuator energy. A type of "quantity saturation" sets in and the quantity of fuel injected can no longer be changed by increasing the actuator energy. This means that the adaptation of injections in a defined operating state must not be carried out solely by adapting the energy but by extending the activation period, which consequently prolongs the injection period.

As a result of successfully regulating the irregularity in the running of the engine after step 16, the quantities of fuel injected by the individual injectors are synchronized with one another. These injection parameters are stored for the associated loading/unloading time $\tau_i$ (step 18). A check is carried out in step 19 as to whether the loading/unloading time $\tau_i$ is greater than or equal to an extreme value. The extreme value here stands, for example, at 140 μs. In the above example, the initial value $\tau_0$ lies at 200 μs. It should be noted that the index i here is equal to zero. Since the condition established in step 19 is not fulfilled, the process continues in step 20. Before the next set of parameters is loaded in step 14 the loading/unloading time is first reduced by 10 μs in step 20. Consequently, the loading/unloading time $\tau_1$ now equals 190 As. In step 21, only the index is increased by 1. The existing injection parameters for $\tau_1$ are now loaded in step 14. As already described above, the steps 15 to 19 then follow. When all the sets of parameters are adapted for the various loading/unloading times, the constant injection pressure (e.g. 1500 bar) can be set to a different new constant injection pressure (e.g. 1400 bar). As soon as the new pressure is applied in step 12, the actuator energy for every loading/unloading time from 200 to 140 μs is determined according to steps 14 to 19. This can be carried out for various pressure values. As soon as a sufficiently large number of measurement values are available, the method ends in step 22. It should be noted that the gradual changing of the loading/unloading time by 10 μs in step 20 was given only by way of example. For more refined modeling, differences of 1 μs from one loading/unloading time to the next loading/unloading time are entirely conceivable. This inventive diagnosis can be implemented very quickly since just a few piston strokes suffice.

In summary, the inventive method makes it possible for the diagnosis of differences in the quantity of fuel injected or of the injection quantity itself to be carried out at a preferred low operating point at which the maximum sensitivity and reliability of regulation of the irregularity in the running of the engine exists. At this operating point, the diagnosis and adaptation then also take place for injection parameter values which are valid under operating conditions for other operating points. Thus, at the low operating point both a synchronizing of the injection quantity differences between the individual injectors and a calibration of the injection quantity to the pertinent values of the selected injection parameter set artificially in the diagnostic cycle occur, an unwanted movement of the adaptation operating point being prevented or limited by the contrary setting of other injection parameter values. The synchronizing of quantities of fuel injected through regulation of the energy of the injector activation parameter depending, in particular, on the injection parameter of pressure, is preferred.

Optionally, it is possible at the set operating point, based on knowledge of the engine operating state (temperature of coolant, active consumers) to read out from the torque model the absolute value of the injection quantity and to use it, for example, for the exact calibration of the injection quantity/injection period characteristics map.

What is claimed is:

1. A method for synchronizing, between the cylinders of an internal combustion engine, the differences in the quantity of fuel injected, comprising the steps of:

determining the differences in the quantity of fuel injected which exist at a low operating point in the lower engine-speed range with the injection parameter values valid at that point under normal operating conditions by means of a method of measuring individual cylinders to record irregularities in the running of the internal combustion engine, assigning the differences to the low operating point, for operating ranges with higher loads and engine speeds, adapting the differences in the quantity of fuel injected for a chosen injection parameter, at the low operating point, setting the chosen injection parameter for adaptation to a value which deviates from the value applicable at that point under normal operating conditions, for the set value, determining the differences in the quantity of fuel injected by means of measurement of the irregularities in the running of the engine, and storing the differences as adaptation values which are assigned to the respective injection parameter value, wherein during the adaptation the movement of the operating point, which changes with the injection parameter value set, respectively, is limited, wherein, in order to limit the movement of low operating point during adaptation, at least one second injection parameter is set such that the operating point remains at least approximately stationary.

2. A method according to claim 1, wherein, in the process of adaptation to successively higher values of the injection pressure chosen as an injection parameter, a correspondingly shorter injection period is set in order to limit the movement of the low operating point.

3. A method according to claim 1, wherein, in the process of adaptation to successively lower values of the injection pressure chosen as an injection parameter, a correspondingly longer injection period is set in order to limit the movement of the low operating point.

4. A method according to claim 1, wherein the injection pressure is changed gradually by a defined amount.

5. A method according to claim 1, wherein for the adaptation a low operating point is selected at which the maximum sensitivity and/or reliability of measurement of the irregularity in the running of the engine is achieved.

6. A method according to claim 1, wherein the low operating point is chosen in the idling range.

7. A method according to claim 1, wherein the learned adaptation values serve to calculate cylinder-specific correction factors, which are applied to an activation parameter of an injection device of the internal combustion engine such that a synchronization of the quantities of fuel injected occurs.

8. A method according to claim 7, wherein the injection device for each cylinder is formed by an injector with a piezoelectric actuator, wherein the activation energy of the actuators is used as an activation parameter.

9. A method according to claim 8, wherein, for a defined loading/unloading time of the injector, the actuator energy is adapted correspondingly.

10. A method according to claim 9, wherein the loading/unloading time of the main injection is set to an initial value and is gradually changed to an extreme value, wherein with each step the actuator energy is adapted correspondingly.

11. A method according to claim 1, wherein, in order to record the irregularity in the running of the internal combustion engine, the angular acceleration of the crankshaft of the internal combustion engine caused by the differing quantities of fuel injected in individual cylinders is analyzed.

12. A method according to claim 11, wherein, at the stationary operating point set for adaptation with synchronized quantities of fuel injected, the absolute value of the associated quantity of fuel injected is determined from a stored model of the torque of the internal combustion engine.

13. A system for synchronizing, between the cylinders of an internal combustion engine, the differences in the quantity of fuel injected, comprising:

measurement means for recording irregularities in the running of the internal combustion engine and for determining the differences in the quantity of fuel injected which exist at a low operating point in the lower engine-speed range with the injection parameter values valid at that point under normal operating conditions, means for assigning the differences to the low operating point, means for adapting the differences in the quantity of fuel injected for a chosen injection parameter, means for setting the chosen injection parameter for adaptation to a value which deviates from the value applicable at that point under normal operating conditions, and memory means for storing the differences in the quantity of fuel as adaptation values which are assigned to the respective injection parameter value, wherein during the adaptation the movement of the operating point, which changes with the injection parameter value set, respectively, is limited, wherein, in order to limit the movement of the low operating point during adaptation, at least one second injection parameter is set such that the operating point remains at least approximately stationary.

14. A system according to claim 13, wherein the injection device for each cylinder is formed by an injector with a piezoelectric actuator, wherein the activation energy of the actuators is used as an activation parameter.

15. A system according to claim 14, wherein, for a defined loading/unloading time of the injector, the actuator energy is adapted correspondingly.

16. A system according to claim 15, wherein the loading/unloading time of the main injection is set to an initial value and is gradually changed to an extreme value, wherein with each step the actuator energy is adapted correspondingly.

17. A system according to claim 13, wherein, in order to record the irregularity in the running of the internal combustion engine, the angular acceleration of the crankshaft of the internal combustion engine caused by the differing quantities of fuel injected in individual cylinders is analyzed.

18. A system according to claim 17, wherein, at the stationary operating point set for adaptation with synchronized quantities of fuel injected, the absolute value of the associated quantity of fuel injected is determined from a stored model of the torque of the internal combustion engine.

* * * * *